US007244188B2

(12) United States Patent
Best

(10) Patent No.: US 7,244,188 B2
(45) Date of Patent: Jul. 17, 2007

(54) MULTI-PIECE GOLF CLUB HEAD WITH IMPROVED INERTIA

(75) Inventor: Christopher B. Best, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/064,965

(22) Filed: Feb. 25, 2005

(65) Prior Publication Data

US 2006/0194641 A1 Aug. 31, 2006

(51) Int. Cl.
*A63B 53/04* (2006.01)

(52) U.S. Cl. ..... 473/291; 473/332; 473/350

(58) Field of Classification Search ..... 473/332, 473/334, 337, 290–291, 335–336, 350
See application file for complete search history.

(56) References Cited

U.S. PATENT DOCUMENTS 1,319,233 A * 10/1919 Mattern ..... 473/337
1,534,600 A * 4/1925 Mattern ..... 473/337
4,687,205 A * 8/1987 Tominaga et al. ..... 473/348
4,811,950 A * 3/1989 Kobayashi ..... 473/335
4,874,171 A * 10/1989 Ezaki et al. ..... 473/290
4,957,294 A * 9/1990 Long ..... 473/350
5,377,985 A * 1/1995 Ohnishi ..... 473/324
5,413,336 A * 5/1995 Iwanaga ..... 473/291
5,544,885 A 8/1996 Besnard et al. ..... 473/350
5,643,112 A 7/1997 Besnard et al. ..... 473/350
6,306,048 B1 * 10/2001 McCabe et al. ..... 473/333
6,478,690 B2 * 11/2002 Helmstetter et al. ..... 473/324
6,769,998 B2 * 8/2004 Clausen et al. ..... 473/342
2002/0165041 A1 * 11/2002 Takeda ..... 473/334
2004/0023730 A1 * 2/2004 Nagai et al. ..... 473/345
2004/0116200 A1 * 6/2004 Helmstetter et al. ..... 473/291
2005/0096151 A1 * 5/2005 Hou et al. ..... 473/335
2006/0025234 A1 * 2/2006 Nicolette et al. ..... 473/334

* cited by examiner

*Primary Examiner*—Stephen L. Blau
(74) *Attorney, Agent, or Firm*—Bingham McCutchen LLP

(57) ABSTRACT

A multi-piece iron-type golf club head with a substantial weight member is disclosed and claimed. The golf club head includes a plurality of body members. A first body member includes a face, a rear surface, and a hosel. A viscoelastic material is attached to the rear surface, and a second body member is attached to the viscoelastic material. The second body member, which may be a weight member, has a substantially larger mass than in known golf clubs.

16 Claims, 3 Drawing Sheets

MULTI-PIECE GOLF CLUB HEAD WITH IMPROVED INERTIA

BACKGROUND OF THE INVENTION

1. Field of the Invention

The present invention relates to a golf club head, and, more particularly, the present invention relates to a multi-piece iron-type golf club head with a substantial weight member.

2. Description of the Related Art

Golf club heads come in many different forms and makes, such as wood- or metal-type, iron-type (including wedge-type club heads), utility- or specialty-type, and putter-type. Each of these styles has a prescribed function and make-up.

Iron-type golf clubs generally include a front or striking face, a top line, and a sole. The front face interfaces with and strikes the golf ball. A plurality of score lines or grooves is provided on the face to assist in imparting spin to the ball. The top line is generally configured to have a particular look to the golfer and to provide weight. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 2 through number 9, and a pitching wedge. Other wedges, such as a lob wedge, a gap wedge, and a sand wedge, may be optionally included with the set. Each iron has a shaft length that usually decreases through the set as the loft for each club head increases from the long irons to the short irons. The length of the shaft, along with the club head loft, moment of inertia, and center of gravity location, impart various performance characteristics to the ball's launch conditions upon impact and determine the distance the ball will travel. Flight distance generally increases with a decrease in loft angle. However, difficulty of use also increases with a decrease in loft angle.

Iron-type golf clubs generally can be divided into three categories: blades, muscle backs, and cavity backs. Blades are traditional clubs with a substantially uniform appearance from the sole to the top line, although there may be some tapering from sole to top line.

Muscle backs have a substantially traditional appearance and are similar to blades, but have extra material on the back. This extra material, which may be in the form of a rib, can be used to lower the club head center of gravity. Having the club head center of gravity lower than the ball center of gravity at contact facilitates the golf shot.

Since blade and muscle back designs have a small sweet spot (that is, the area of the face that results in a desirable golf shot upon striking a golf ball), they are relatively difficult to use and are therefore typically only used by skilled golfers. However, these clubs have the benefit of producing longer golf shots than other designs. Furthermore, since these designs are typically made of relatively soft forged steel, they allow the golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. This also allows the size of the club face to be increased, also resulting in a larger sweet spot. The perimeter weighting created by the cavity also increases the club's moment of inertia, which is a measurement of the club's resistance to torque, for example the torque resulting from an off-center hit. These clubs are easier to hit than blades and muscle backs, and are therefore usable by less-skilled and beginner golfers.

Other known golf clubs achieve a desired balance or moment of inertia by adding a weight to the club. These clubs typically add a weight member to the bottom surface of the sole, in the center thereof.

SUMMARY OF THE INVENTION

The present invention relates to a multi-piece iron-type golf club head with a substantial weight member. The golf club head includes a plurality of body members. A first body member includes a face, a rear surface, and a hosel. The rear surface may be curved such that it has a concave profile. A viscoelastic material is attached to the rear surface, and a second body member is attached to the viscoelastic material. The second body member, which may be a weight member, has a substantially larger mass than in known golf clubs. A preferred mass is 10 grams, but it may be as large as 300 grams or more. Characterized differently, the weight member may make up from 4% to 75% of the total club head weight. The back of the club head includes a recess to bias the club head mass towards the club head perimeter, improving the club head moment of inertia and enlarging the sweet spot.

The multi-piece design of the present invention allows the club designer to separate the structural and non-structural aspects of the club, which allows the designer to independently manipulate and design the structural and cosmetic properties of the head. The design further allows the designer more options in choosing the weighting, inertial, and damping characteristics of the club head, which affect the feel and forgiveness of the golf club. For example, the clubs may be designed such that all of the clubs in the set have substantially the same moment of inertia, helping to create a constant feel throughout the set regardless of the club used.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
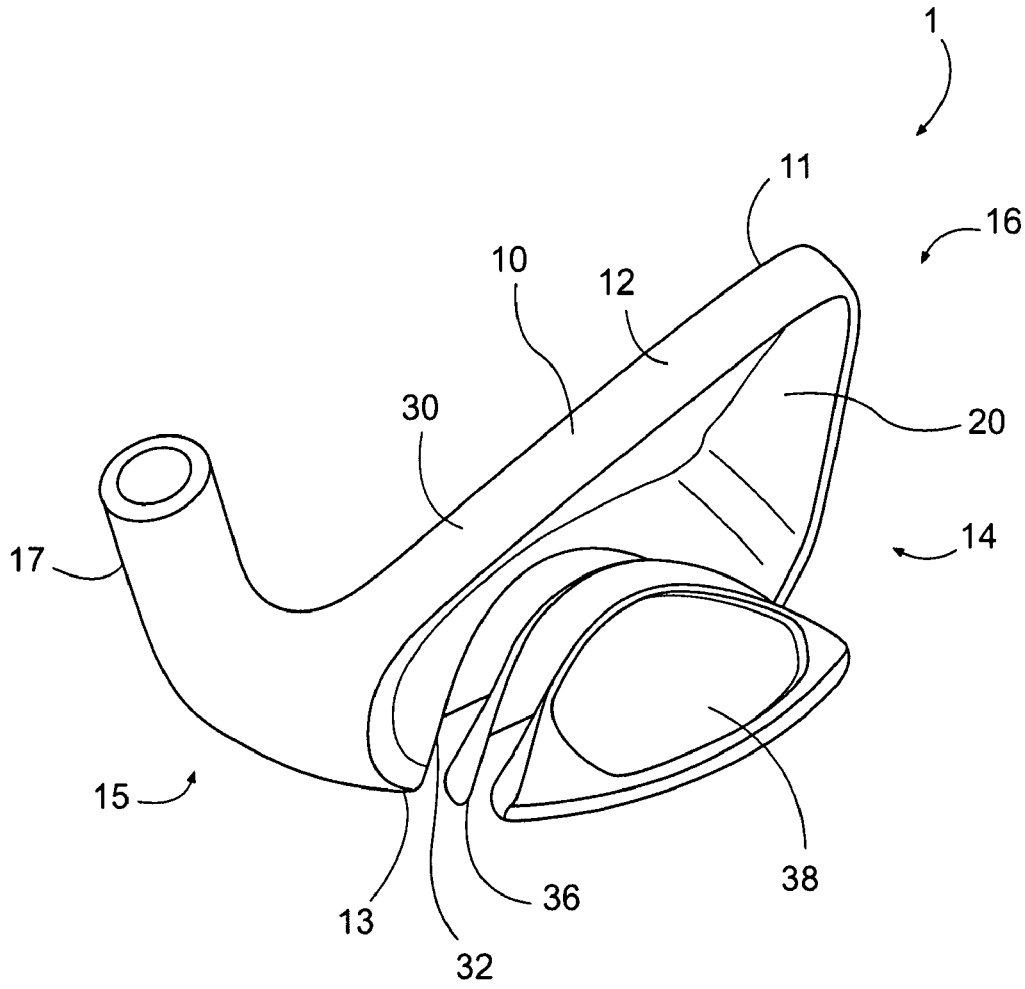
FIG. 1 shows a rear view of a golf club head of the present invention.

FIG. 1 shows the front side of a golf club head 1 of the present invention. The golf club head 1 includes a body 10 defining a front surface 11, a top line 12, a sole 13, a back 14, a heel 15, a toe 16, and a hosel 17. The striking face of the front surface 11, which preferably contains grooves or score lines therein, may be unitary with the body 10, or it may be a separate body, such as an insert, coupled thereto.

The back 14 contains a recess 20 therein, located between the heel 15 and the toe 16. The recess 20 removes material from the club head 1, which inherently provides more of the club head mass towards the perimeter of the club head 1, producing a greater moment of inertia (MOI) measured about a vertical axis passing through the club head center of gravity (with the club grounded in the address position), increasing the size of the club head sweet spot, and lowering the club head center of gravity. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits. Moving or rearranging mass to the club head perimeter enlarges the sweet spot and produces a more forgiving club.

Figure 2:
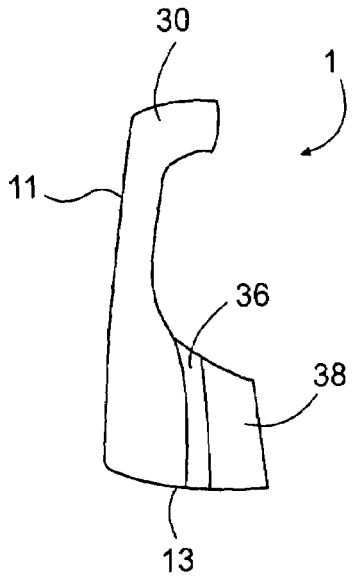
FIG. 2 show a cross-sectional views through the club head of FIG. 1.
Figure 3:
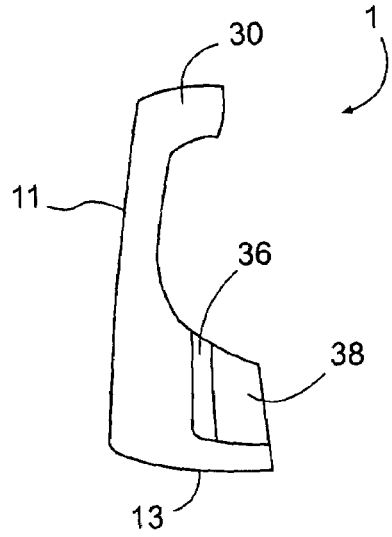
FIG. 3 shows a cross-sectional views through an alternate embodiment of the club head of FIG. 1.

The club head 1 is separated into two main pieces. A first body member 30 includes the face 11 and hosel 17, and defines a rear surface 32. A second body member 38 is coupled to the first body member along the surface 32. A viscoelastic material 36, such as urethane or polyurethane, preferably is coupled to the surface 32 intermediate the first and second body members 30, 38. The coupling of the viscoelastic material 36 and the body members 30, 38 may be accomplished in known manner, such as via an adhesive. FIGS. 2 and 3 show cross-sectional views through the club head 1. As shown in FIG. 2, the sole 13 may be comprised of both the first and second body members 30, 38. Alternatively, as shown in FIG. 3, the sole 13 may be comprised solely of the first body member 30.

When designing golf club heads, the designer must be aware of both structural and non-structural concerns and constraints. The designer must position the mass, center of gravity, loft and lies angles, and other structural properties while simultaneously being mindful of the overall appearance and other non-structural properties of the club head. The club head 1 of the present invention comprises two substantial body member pieces 30, 38. By separating the head into a plurality of substantial pieces, the designer is better able to manipulate and design the mass properties of the head 1 as the non-structural material used in the head 1 is independent of the structural/visual components.

Known golf club heads typically employ constrained layer damping, in which a "sandwich" construction of a viscoelastic material and a relatively stiff constraining layer is provided. This design relies solely on the natural properties of the club head components to dampen vibrations generated during use of the golf club. In the present golf club head 1, the first body member 30 is provided with a large cut-out region forming the rear surface 32, which preferably has a concave profile extending from the heel 15 to the toe 16. The second body member 38, which may be referred to as a weight member, preferably has a mass of at least 10 grams. Having a second body member 38 with a substantial mass allows the club head designer to create a mass/spring system to reduce vibrations within the club head 1. Furthermore, it allows the designer to use a greater variety of viscoelastic materials, and get a greater response from the mass/spring system than with previous designs. The weight member 38 preferably may be from 50 to 300 grams, and preferably is at least 100 grams. Characterized differently, the weight member 38 comprises from 4% to 75% of the club head weight, and more preferably from 25% to 50% of the club head weight. The viscoelastic material 36 preferably may be selected from a group of viscoelastic materials, with each of the materials having different functional characteristics. For example, the plurality of viscoelastic materials 36 may be chosen to provide a variety of damping coefficients. Thus, by merely altering the viscoelastic member 36, a variety of clubs with different feels can be provided, allowing golfers a variety of options to tailor the equipment to their specific needs.

Known sets of golf clubs have varying MOI's throughout the set. The size and weight of the club head generally increases through the set with an increase in loft angle. Thus, a pitching wedge is bigger and heavier than a 3-iron. Since MOI is a function of the distance from the club head mass to the center of gravity (or other reference), the MOI of known sets of golf clubs generally increase through the set with an increase in loft angle. The design of the instant club head 1 also advantageously allows the club head designer to maintain substantially constant inertia values throughout the set by selecting a weight member 38 of the appropriate mass. Preferably, the moments of inertia for each club head within the set are substantially equal and have an MOI within the range of 2400 $g \cdot cm^2$ to 2900 $g \cdot cm^2$, with 2500 $g \cdot cm^2$ to 2700 $g \cdot cm^2$ being more preferred. Preferably, the difference between a maximum and a minimum of the moments of inertia is 40 $g \cdot cm^2$ or less. More preferably, this difference is 20 $g \cdot cm^2$ or less. Alternatively, the set may be designed to vary the MOI throughout the set in a desired fashion, such as having lower inertia in the shorter irons. As another alternative, the MOI can be matched to swing speed. Each iron has a shaft length that usually decreases through the set as the loft for each club head increases from the long irons to the short irons. Thus, the swing speed typically decreases through the set from the long irons to the short irons. The design of the instant club head 1 allows the designer to set match the MOI with swing speed, such that MOI increases with a decrease in club speed. As used herein, a set of clubs includes at least three club heads, and more preferably includes at least five club heads, and contains clubs that a golfer would use in a normal round of golf. The set preferably may contain one or more utility-type clubs. Utility-type clubs may be included in place of or in addition to the long irons, such as 3-iron and/or a 4-iron.

Figure 4:
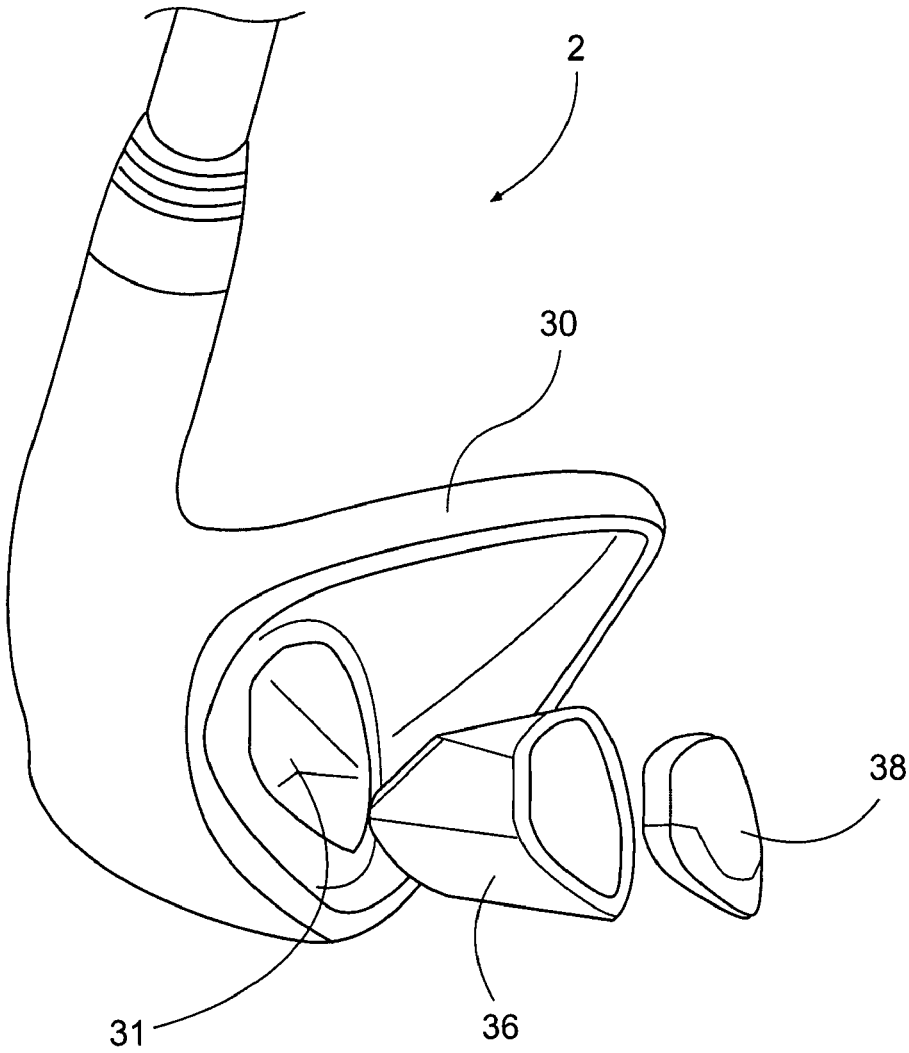
FIG. 4 shows a rear view of a second golf club head of the present invention.

FIG. 4 shows an exploded rear view of a second golf club head 2 of the present invention. This club head 2 has the same general construction as the first club head 1, and provides the same benefits. In this embodiment, the sole is comprised only of the first body member 30, as discussed above in conjunction with FIG. 3. The first body member 30 defines a recess 31, into which the viscoelastic material 36 and the second body member 38 are positioned. As shown in FIG. 4, the layer of viscoelastic material 36 is more substantial than that shown in FIG. 1 with respect to the first golf club head 1. This may preferably allow the same second body member 38 to be used with multiple club heads within a set. A larger amount of viscoelastic material 36 may also allow the club designer to achieve a greater variety of club head characteristics, such as feel, vibration damping, MOI, etc.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. An iron-type golf club head, comprising:

a first body member including a face, a rear surface, and a hosel;

a viscoelastic material coupled to said rear surface; and a second body member coupled to said viscoelastic material;

wherein said second body member is a weight member with a mass of at least 10 grams;

wherein at least a portion of said rear surface has a concave profile extending from a heel of said club head to a toe of said club head and viscoelastic material is coupled to said rear surface within said concave profile; and wherein the club head further comprises a center of gravity and a moment of inertia measured about a vertical axis passing through said center of gravity from approximately 2400 $g \cdot cm^2$ to approximately 2900 $g \cdot cm^2$.

2. The golf club head of claim 1, wherein said weight member has a mass of 50 to 300 grams.

3. The golf club head of claim 1, wherein said weight member has a mass of at least 100 grams.

4. The golf club head of claim 1, wherein the club head has a weight and said weight member comprises from 4% to 75% of said club head weight.

5. The golf club head of claim 1, wherein the club head has a weight and said weight member comprises from 25% to 50% of said club head weight.

6. The golf club head of claim 1, wherein said second body member is coupled to said viscoelastic material within said concave profile.

7. The golf club head of claim 1, wherein the golf club head includes a sole comprised at least in part by said second body member.

8. The golf club head of claim 1, wherein the golf club head includes a sole comprised entirely by said first body member.

9. The golf club head of claim 1, wherein said viscoelastic material is selected from a group of viscoelastic materials, with each of said materials having different functional characteristics.

10. The golf club head of claim 1, wherein said moment of inertia is from approximately 2500 $g \cdot cm^2$ to approximately 2700 $g \cdot cm^2$.

11. The golf club head of claim 1, wherein said first body member, said viscoelastic material, and said second body member form a mass/spring system to reduce vibrations within the club head.

12. A set of golf clubs, comprising:

a plurality of golf club heads, wherein each head includes:

a first body member including a face, a rear surface, and a hosel;

a second body member coupled to said rear surface;

a viscoelastic material intermediate said first and second body members; and a center of gravity and a moment of inertia measured about a vertical axis passing through said center of gravity;

wherein each of said moments of inertia are substantially the same; and wherein a difference between a maximum and a minimum of said moments of inertia is 40 $g \cdot cm^2$ or less.

13. The set of claim 12, wherein said moments of inertia are from approximately 2400 $g \cdot cm^2$ to approximately 2900 $g \cdot cm^2$.

14. The set of claim 13, wherein said moments of inertia are from approximately 2500 $g \cdot cm^2$ to approximately 2700 $g \cdot cm^2$.

15. The set of claim 12, wherein said difference is 20 $g \cdot cm^2$ or less.

16. The set of claim 12, wherein the set includes at least three club heads.

* * * * *